US011199044B2

(12) United States Patent
Li et al.

(10) Patent No.: US 11,199,044 B2
(45) Date of Patent: Dec. 14, 2021

(54) FRAME STRUCTURE AND SLIDING DOOR

(71) Applicant: Shenzhen Hopo Window Control Technology Co., Ltd., Guandong (CN)

(72) Inventors: Shupeng Li, Guangdong (CN); Jieying Huang, Guangdong (CN); Chen Deng, Guangdong (CN); Xiaojuan Qin, Guangdong (CN)

(73) Assignee: SHENZHEN HOPO WINDOW CONTROL TECHNOLOGY CO., LTD., Guangdong (CN)

( * ) Notice: Subject to any disclaimer, the term of this patent is extended or adjusted under 35 U.S.C. 154(b) by 607 days.

(21) Appl. No.: 16/086,353

(22) PCT Filed: Dec. 11, 2017

(86) PCT No.: PCT/CN2017/115507
§ 371 (c)(1),
(2) Date: Sep. 19, 2018

(87) PCT Pub. No.: WO2018/218928
PCT Pub. Date: Dec. 6, 2018

(65) Prior Publication Data

US 2021/0180392 A1 Jun. 17, 2021

(30) Foreign Application Priority Data

May 27, 2017 (CN) ..... 201710396202.6

(51) Int. Cl.
*E06B 3/46* (2006.01)
*E05D 15/06* (2006.01)
*E05D 13/00* (2006.01)

(52) U.S. Cl.
CPC ..... *E06B 3/4636* (2013.01); *E05D 15/0669* (2013.01); *E06B 3/4609* (2013.01);
(Continued)

(58) Field of Classification Search
CPC ..... E05D 15/066; E05D 15/0691; E05D 15/0634; E05D 13/00; E06B 3/4636;
(Continued)

(56) References Cited

U.S. PATENT DOCUMENTS 3,261,129 A * 7/1966 Brydolf ..... E05D 15/0626 49/411
3,281,993 A * 11/1966 Riegelman ..... E05D 15/066 49/425

(Continued)

FOREIGN PATENT DOCUMENTS

CN 1696472 A 11/2005
CN 101169022 A 4/2008

(Continued)

OTHER PUBLICATIONS

International Search Report for corresponding PCT Application No. PCT/CN2017/115507 dated Mar. 5, 2018.

*Primary Examiner* — Justin B Rephann
(74) *Attorney, Agent, or Firm* — Wood, Phillips, Katz, Clark & Mortimer

(57) ABSTRACT

A frame structure includes a frame body, a corner connector and roller mechanism arranged in a splice of adjacent side frames at a bottom of the frame body, and a guide mechanism clamped to a top of the frame body. A glass positioning slot is disposed on a first side of an inner side wall of a side frame of the frame body. A mounting slot is disposed on a first side of an outer side wall of the side frame of the frame body and used for fixing the guide mechanism or the corner connector and roller mechanism. The glass positioning slot is adjacent to the mounting slot along a lengthwise direction of the first side of the inner side wall. A sliding door is further provided.

16 Claims, 11 Drawing Sheets

(52) U.S. Cl.
CPC ..... *E05D 13/00* (2013.01); *E05Y 2201/688* (2013.01); *E05Y 2900/132* (2013.01); *E05Y 2900/148* (2013.01)

(58) Field of Classification Search
CPC ..... E06B 3/4609; E05Y 2201/688; E05Y 2900/132; E05Y 2900/148
See application file for complete search history.

(56) References Cited

U.S. PATENT DOCUMENTS 3,299,575 A * 1/1967 Ray ..... E05D 15/0669 49/420
3,386,208 A * 6/1968 Banner ..... E05D 15/0669 49/420
3,516,215 A * 6/1970 Day ..... E05D 15/063 52/656.9
3,619,947 A * 11/1971 Burum ..... E05D 15/0669 49/265
3,716,890 A * 2/1973 Benson ..... E05D 15/0669 16/91
3,729,868 A * 5/1973 Burum ..... E06B 3/9647 49/420
3,826,044 A * 7/1974 Armstrong ..... E05D 15/066 49/420
4,006,513 A * 2/1977 Offterdinger ..... E05D 15/0669 16/99
4,030,160 A * 6/1977 Lambertz ..... E05D 15/0669 16/105
4,123,874 A * 11/1978 Scott ..... E05D 15/0634 49/411
4,189,870 A * 2/1980 Helmick ..... E05D 15/0669 16/105
4,193,500 A * 3/1980 Scott ..... E05D 15/0634 16/105
4,353,186 A * 10/1982 Offterdinger ..... E05D 15/0669 16/105
4,850,145 A * 7/1989 McAfee ..... E05D 15/0669 49/501
4,873,741 A * 10/1989 Riegelman ..... E05D 15/0669 16/105
5,119,872 A * 6/1992 Engebretson ..... E05D 15/066 16/105
5,343,594 A * 9/1994 Harvey ..... A47K 3/34 16/105
5,724,770 A * 3/1998 McAfee ..... E05D 15/066 49/404
5,860,189 A * 1/1999 An ..... E05D 15/0669 16/91
6,813,862 B2 * 11/2004 Perich ..... E05B 65/0876 16/105
7,021,007 B2 * 4/2006 Jacobs ..... E05D 15/0669 16/87 R
7,647,729 B2 * 1/2010 Polus ..... E05D 15/0669 49/425
7,942,184 B2 * 5/2011 Cech ..... E06B 9/36 160/84.05
8,955,195 B2 * 2/2015 Chang ..... E05D 15/0634 16/91
9,611,684 B2 * 4/2017 Zimmer ..... E05D 15/0669
2005/0000164 A1 * 1/2005 Jacobs ..... E05D 15/0691 49/425
2007/0017157 A1 * 1/2007 Ambrozus ..... E05D 15/0669 49/425

FOREIGN PATENT DOCUMENTS

CN 107120036 A 9/2017
CN 206785226 U 12/2017

* cited by examiner

FRAME STRUCTURE AND SLIDING DOOR

CROSS REFERENCE TO RELATED APPLICATIONS

This is a National Stage Application, filed under 35 U.S.C. 371, of International Patent Application No. PCT/CN2017/115507, filed on Dec. 11, 2017, which claims priority to Chinese patent application No. 201710396202.6 filed on May 27, 2017, contents of both of which are incorporated herein by reference in their entireties.

TECHNICAL FIELD

The present disclosure relates to a technical field of doors and windows, for example, relates to a frame structure and a sliding door.

BACKGROUND

In a related art, a guide mechanism at the top of a window sash of a sliding door or window is fixed to the window sash by screws. Since a material with a thin wall is adopted by the window sash, the guide mechanism is easy to fall off during the process of sliding. The roller disposed on a bottom frame of the window sash is fixed to the window sash by screws. The gap between a window frame and the window sash cannot be adjusted by means of fixing the roller to the window sash by screws. In another related art, adjacent side frames are connected by using a corner connector and the roller is fixed to the bottom frame, that is, installing the corner connector and the roller separately, is a complex process of assembling casement and frame.

For the structure of the window sash in the related art, since the glass mounting slot is located right above the roller, the frame of the window sash is wide and the glass area not embedded in the frame is small, the permeability of the door or window is reduced.

SUMMARY

Provided is a frame structure and a sliding door capable of increasing the area of the glass not embedded in the frame and facilitating assembling of the frame body A frame structure includes a frame body; a corner connector and roller mechanism arranged at a splice of adjacent side frames at a bottom of the frame body; and a guide mechanism clamped to the top of the frame body, where a glass positioning slot is disposed on a first side of an inner side wall of a side frame of the frame body, a mounting slot is disposed on a first side of an outer side wall of the side frame of the frame body and used for fixing the guide mechanism or the corner connector and roller mechanism, and the glass positioning slot is adjacent to the mounting slot along a lengthwise direction of the first side of the inner side wall.

In one embodiment, the corner connector and roller mechanism includes a corner connector for splicing and mounting the adjacent side frames, and a roller adjustment assembly for regulating a gap between the frame body and an external frame part, which is integrally arranged in a cavity of the corner connector.

In one embodiment, the corner connector includes a first corner connector unit, a second corner connector unit and a locking mechanism disposed between the first corner connector unit and the second corner connector unit, the locking mechanism includes a first adjusting screw and an adjusting block installed with the first adjusting screw, the first corner connector unit and the second corner connector unit are separately provided with a positioning sliding slot, the positioning sliding slot of the first corner connector unit is opposite to the positioning sliding slot of the second corner connector unit, and the locking mechanism is disposed in the two positioning sliding slots.

In one embodiment, the roller adjustment assembly includes an outer support, an inner support arranged on an inner side of the outer support and a second adjusting screw disposed at an end of the outer support and installed in the corner connector.

In one embodiment, a first side wall of the inner support is a side of the inner support facing away from the outer support, a roller adjusting shaft is disposed between first side walls of two inner supports, two ends of the roller adjusting shaft penetrate through the inner support, the roller adjusting shaft is slidable in a sliding slot disposed through a side wall of the outer support, an angle between an extension direction of the sliding slot and a lengthwise direction of the side wall of the outer support is not 0, and each of the two ends of the roller adjusting shaft is disposed in a respective one of positioning slots on two opposite side walls of the cavity of the corner connector.

In one embodiment, the guide mechanism includes a base assembly inserted into the mounting slot, and a roller assembly disposed on the base assembly, the base assembly includes a base fixed plate and a base sliding plate disposed on the base fixed plate slidable relative to the base fixed plate, a first groove is disposed on an upper surface of the base fixed plate, a first protrusion is disposed on a lower surface of the base sliding plate, and the first protrusion is embedded in and cooperates with the first groove;

when the base sliding plate slides along a lengthwise direction of the base fixed plate and the first protrusion is embedded in the first groove, the base assembly is loosely fitted with the mounting slot; and when the base sliding plate slides along the lengthwise direction of the base fixed plate and the first protrusion is not embedded in the first groove, the base assembly is tightly fitted with the mounting slot.

In one embodiment, the guide mechanism further includes an adjusting slide plate for adjusting a deflection of the roller assembly along a width direction of the base assembly, which is disposed between the roller assembly and the base sliding plate, a protruding point protruding towards the base sliding plate is disposed on a lower surface of the adjusting slide plate and used for reducing friction between the adjusting slide plate and the base sliding plate, and the protruding point is slidable relative to a top surface of the base sliding plate.

In one embodiment, the roller assembly includes a fixed plate, a rolling shaft disposed vertical to the fixed plate, and a roller disposed on the top of the rolling shaft; the adjusting slide plate is provided with a first waist-shaped groove, a second waist-shaped groove and a third waist-shaped groove sequentially disposed at intervals along a lengthwise direction of the adjusting slide plate, and an angle between the second waist-shaped groove and the lengthwise direction of the adjusting slide plate is not 0; the adjusting slide plate is connected to the base sliding plate by a first riveting shaft running though the first waist-shaped groove; the fixed plate is connected to the base sliding plate by a second riveting shaft running though the second waist-shaped groove; the fixed plate, the adjusting slide plate and the base sliding plate are connected by a third riveting shaft running through the third waist-shaped groove; a first bending arm is disposed at an end of the base fixed plate, a second bending arm is disposed at an end of the base sliding plate, and a third bending arm is disposed at an end of the adjusting slide plate; and the first bending arm is connected to the second bending arm by a third adjusting screw provided with screw threads, and the second bending arm is connected to the third bending arm by a fourth adjusting screw provided with screw threads.

A sliding door includes the above-mentioned frame structure; an outer frame body; and a door lock disposed on the outer frame body and used for opening and closing a frame body of the frame structure.

In one embodiment, the door lock includes a first handle disposed on a first side of a side frame of the outer frame body, a lock body disposed on a second side of the side frame of the outer frame body, a transmission shaft disposed between the first handle and the lock body, and an actuator meshed with the transmission shaft and slidable along a radial direction of the transmission shaft, the actuator is used for driving a spring bolt which is used for opening and closing the frame body, the spring bolt is clamped to a lock-slot disposed on a side wall of the frame body, the actuator includes a rack disposed on a first side of the transmission shaft and a rack cover disposed on a second side of the transmission shaft and snap-fitted with the rack, and the rack is meshed with a gear secured to the transmission shaft.

In one embodiment, the door lock includes a first handle disposed on a first side of a side frame of the outer frame body, a lock body disposed on a second side of the side frame of the outer frame body, a transmission shaft disposed between the first handle and the lock body, and an actuator meshed with the transmission shaft and slidable along a radial direction of the transmission shaft, the actuator is used for driving a spring bolt for opening and closing the frame body, the locking lever is clamped to a lock seat disposed on a side wall of the frame body, the actuator includes a rack disposed on a first side of the transmission shaft and a rack cover disposed on a second side of the transmission shaft and snap-fitted with the rack, and the rack is meshed with a gear secured to the transmission shaft.

DETAILED DESCRIPTION

The solutions of the present disclosure are described hereinafter through embodiments in conjunction with drawings.

Figure 1:
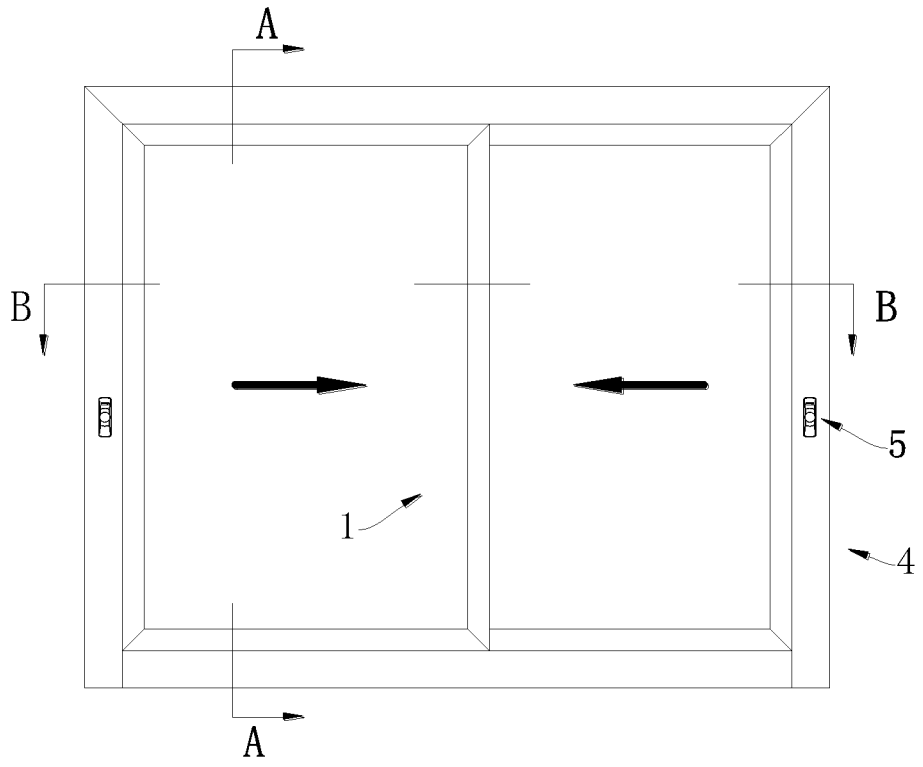
FIG. 1 is a plan view of a sliding door according to an embodiment of the present disclosure.
Figure 2:
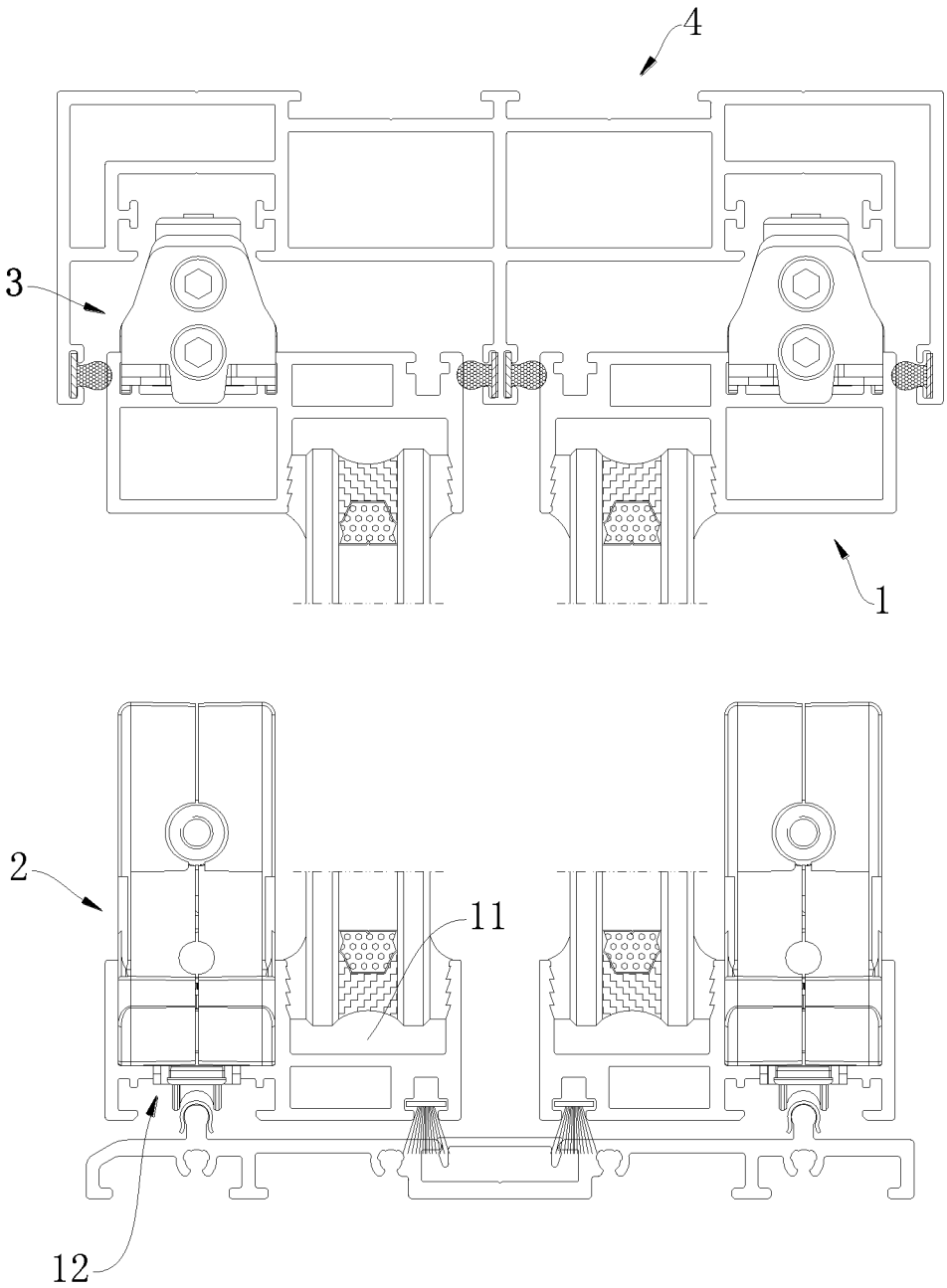
FIG. 2 is a sectional view of FIG. 1 taken along A-A.
Figure 3:
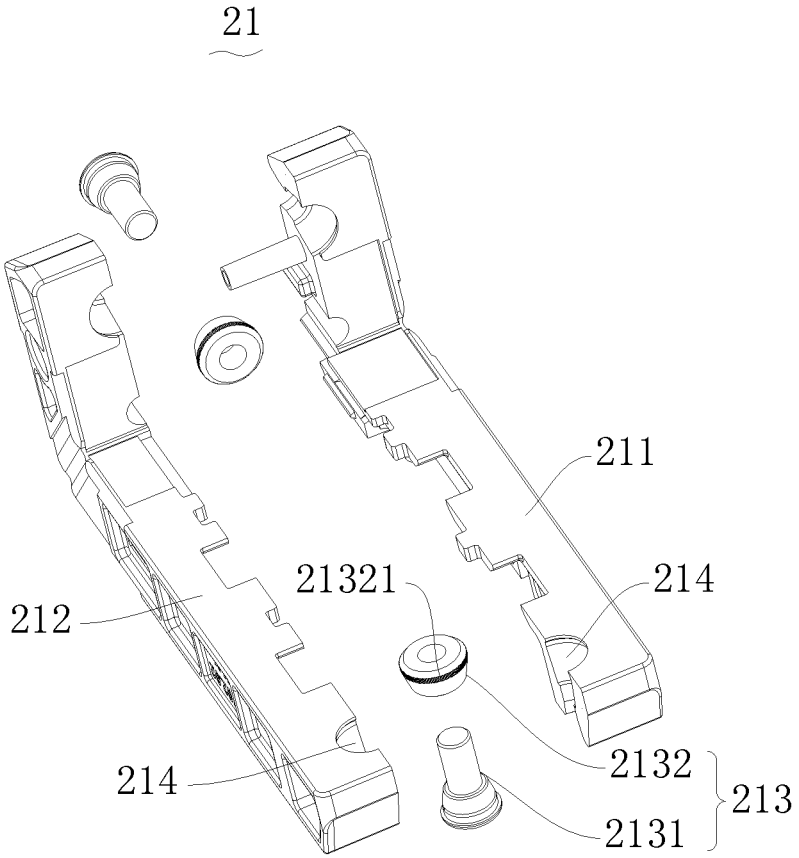
FIG. 3 is an exploded view of a corner connector in a corner connector and roller mechanism in FIG. 2.
Figure 4:
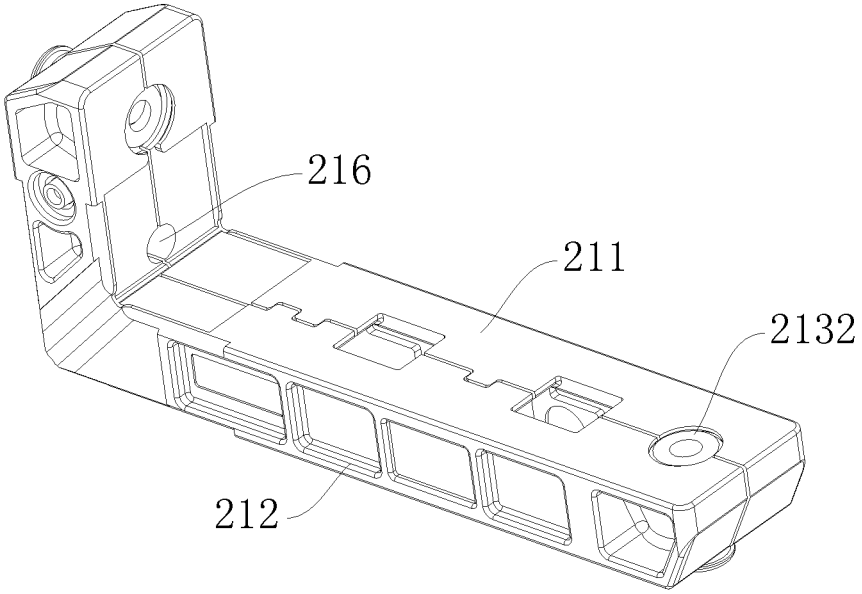
FIG. 4 is an axonometric drawing of the corner connector in the corner connector and roller mechanism in FIG. 2.
Figure 5:
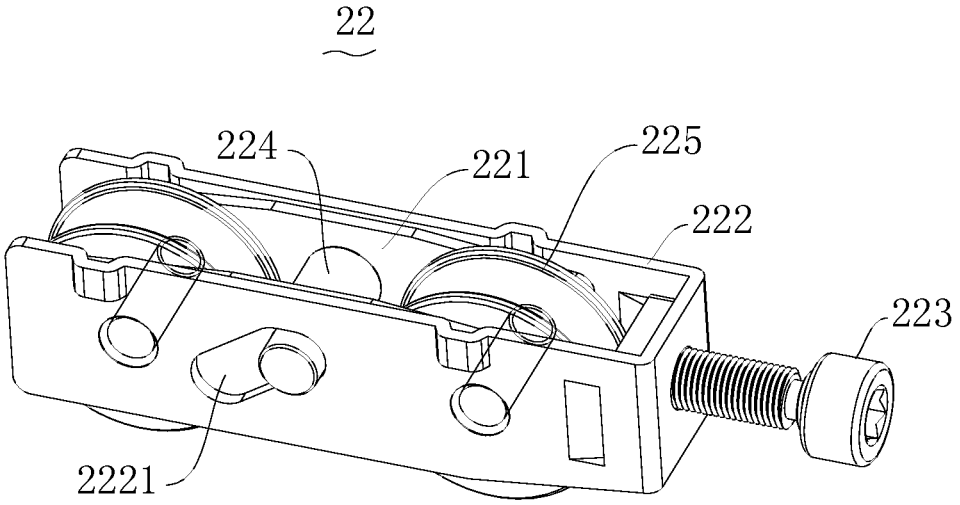
FIG. 5 is an axonometric drawing of a roller adjustment assembly in the corner connector and roller mechanism in FIG. 2.
Figure 6:
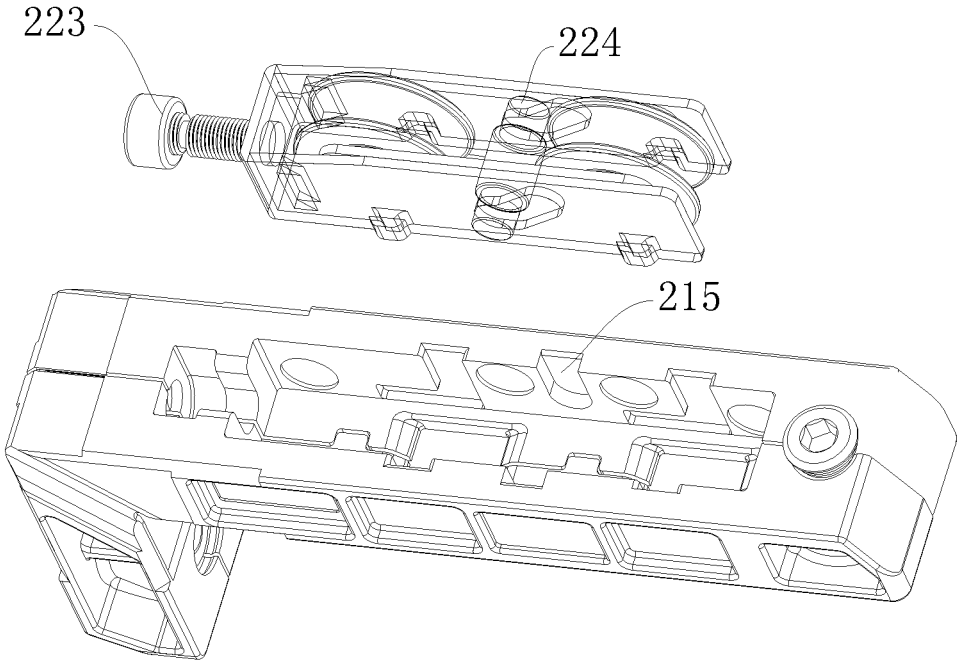
FIG. 6 is an exploded view of the corner connector and roller mechanism in FIG. 2.
Figure 7:
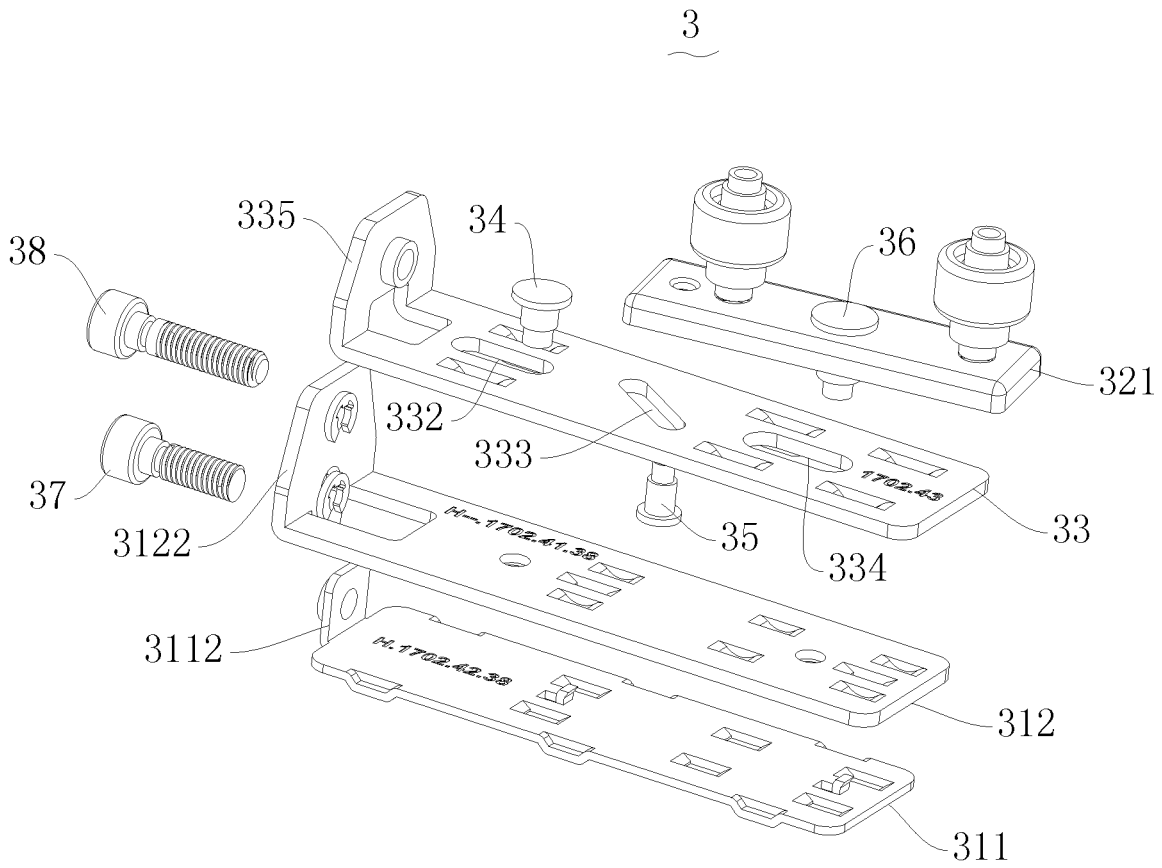
FIG. 7 is an exploded view of a guide mechanism in FIG. 2.
Figure 8:
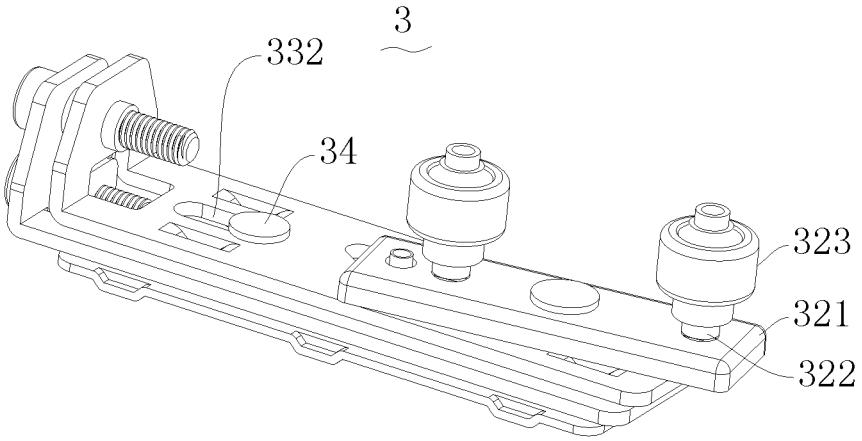
FIG. 8 is an axonometric drawing of the guide mechanism in FIG. 2.
Figure 9:
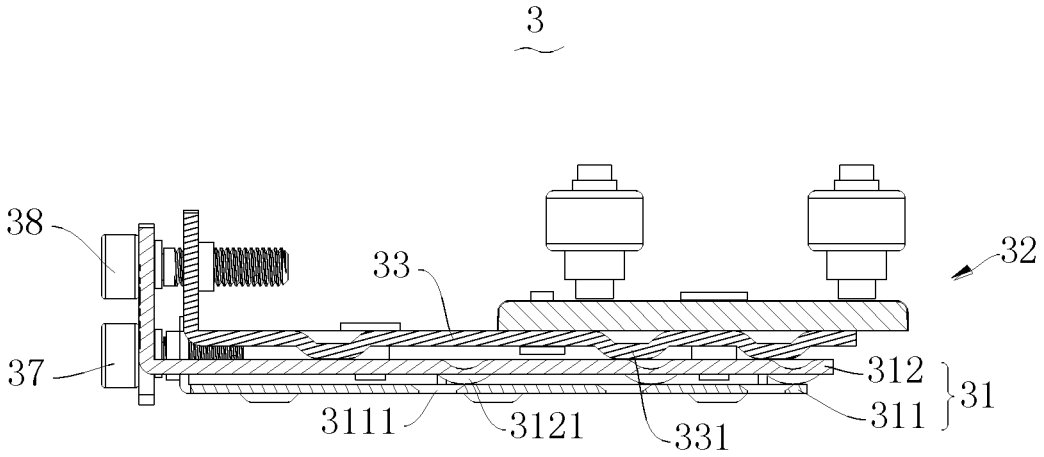
FIG. 9 is a sectional view of the guide mechanism in FIG. 2.

As shown in FIGS. 1 and 2, the present embodiment provides a frame structure. The frame structure may be a door leaf of a sliding door. The frame structure includes a frame body 1, a corner connector and roller mechanism 2 arranged at a splice of adjacent side frames at a bottom of the frame body 1, and a guide mechanism 3 clamped to a top of the frame body 1. As shown in FIG. 1, the frame structure can slide along the directions of the arrows in FIG. 1. A glass positioning slot 11 is disposed on a first side of an inner side wall of a side frame of the frame body 1, a mounting slot 12 for fixing the guide mechanism 3 or the corner connector and roller mechanism 2 is disposed on a first side of an outer side wall of the side frame of the frame body 1 along a lengthwise direction, the glass positioning slot 11 is adjacent to the mounting slot 12 along a lengthwise direction of the first side of the inner side wall. That is, a side edge of the projection of the glass positioning slot 11 on the first side of the inside wall along a lengthwise direction overlaps a side edge of the projection of the mounting slot 12 on the first side of the inside wall along a lengthwise direction.

In one embodiment, in combination with FIG. 2 to FIG. 6, the corner connector and roller mechanism 2 may include a corner connector 21 for splicing and mounting the adjacent side frames, and a roller adjustment assembly 22 for adjusting a gap between the frame body 1 and an external frame part, which is integrally arranged in a cavity of the corner connector 21.

In one embodiment, the corner connector 21 includes a first corner connector unit 211, a second corner connector unit 212 and a locking mechanism 213 disposed between the first corner connector unit 211 and the second corner connector unit 212, the locking mechanism 213 includes a first adjusting screw 2131 and an adjusting block 2132 installed with the first adjusting screw 2131, the first corner connector unit 211 and the second corner connector unit 212 are both provided with a positioning sliding slot 214, the positioning sliding slot 214 of the first corner connector unit 211 is opposite to the positioning sliding slot 214 of the second corner connector unit 212, and the locking mechanism 213 is disposed in the two positioning sliding slots 214.

In one embodiment, skidproof stripe 21321 is disposed on a peripheral side of the adjusting block 2132 to prevent the adjusting block 2132 from rotating along with the first adjusting screw 2131 when connecting with screw threads of the first adjusting screw 2131. The adjusting block 2132 may be configured in a cone shape. The adjusting block 2132 slides along an axial direction of the positioning sliding slots 214 and adjust the gap between the first corner connector unit 211 and the second corner connector unit 212 when the adjusting block 2132 screws in the first adjusting screw 2131 and is subjected to a pulling force of the first adjusting screw 2131.

When the corner connector is inserted into the mounting slots of the two adjacent side frames, the gap between the first corner connector unit 211 and the second corner connector unit 212 may be increased by adjusting the locking mechanism 213, so that the first corner connector unit 211 and the second corner connector unit 212 abut against the internal wall of the mounting slot, thereby reducing the problems brought by fixing the corner connector through screws.

In an embodiment of the present disclosure, the roller adjustment assembly 22 may include an outer support 222, an inner support 221 arranged on an inner side of the outer support and a second adjusting screw 223 disposed at an end of the outer support 222 and installed in the corner connector 21. The inner support 221 and the outer support 222 are slidable relative to each other.

In one embodiment, a first side wall is a side of the inner support 221 facing away from the outer support 222, a roller adjusting shaft 224 is disposed between first side walls of two inner supports 221, two ends of the roller adjusting shaft 224 penetrate through the inner support 221, the roller adjusting shaft 224 is slidable in sliding slot 2221 disposed through a side wall of the outer support 222, an angle between an extension direction of the sliding slot 2221 and a lengthwise direction of the side wall of the outer support is not 0, and each of the two ends of the roller adjusting shaft 224 is disposed in a respective one of positioning slots 215 on two opposite side walls of the cavity of the corner connector 21.

After the roller adjustment assembly 22 is mounted in the cavity of the corner connector, the second adjusting screw can be adjusted to enable the inner support and the outer support to slid relative to each other, enable the roller adjusting shaft 224 and the sliding slot 2221 to slide relative to each other, so that the height of roller 225 exposed outside the top surface of the cavity of the corner connector 21 may be changed. The change of this height brings about a change in the position of frame body because the corner connector is fixed to the frame body.

In an example of installing a door leaf and a door frame, when the side frames of the door leaf are assembled, a corner connector is used to fix adjacent side frames to each other. The roller adjustment assembly is mounted into the cavity of the corner connector. After the door leaf is mounted in the door frame, the second adjusting screw 223 can be adjusted to change the height of roller 225 exposed outside the top surface of the cavity of the corner connector 21 and adjust the gap between the door leaf and the door frame. The above-mentioned structure in the embodiment avoids inflexible sliding caused by unadjustable roller on a lower surface of the door leaf, unsmooth sliding of roller and complex assembly process in the related art.

In combination with FIG. 2, and FIG. 7 to FIG. 9, the guide mechanism 3 may include a base assembly 31 inserted into the mounting slot 12, and a roller assembly 32 disposed on the base assembly 31, the base assembly 31 includes a base fixed plate 311 and a base sliding plate 312 disposed on the base fixed plate 31 and slidable relative to the base fixed plate 311.

In one embodiment, a first groove 3111 is disposed on an upper surface of the base fixed plate 311, a first protrusion 3121 is disposed on a lower surface of the base sliding plate 312, and the first protrusion 3121 is embedded in the first groove 3111.

In one embodiment, when the base sliding plate 312 slides along a lengthwise direction of the base fixed plate 311 and the first protrusion 3121 is embedded in the first groove 3111, there is no gap between the base assembly 312 and the base fixed plate 311, the base assembly 312 is loosely fitted with the mounting slot 12. Optionally, when the base sliding plate 312 slides along a lengthwise direction of the base fixed plate 311 and the first protrusion 3121 is not embedded in the first groove 3111, there is an gap between the base assembly 312 and the base fixed plate 311, the base assembly 31 tightly fitted with the mounting slot 12, the base assembly 31 is secured in the mounting slot 12. Disposing the first protrusion 3121 and embedding the first groove 3111 avoid the destruction of the frame body of the door leaf because of connecting the guide mechanism and the frame body of the door leaf by screws.

In an embodiment of the present disclosure, the guide mechanism 3 further may include an adjusting slide plate 33 for adjusting a deflection of the roller assembly 32 along a width direction of the base assembly 31, which is disposed between the roller assembly 32 and the base sliding plate 312, a protruding point 331 protruding towards the base sliding plate 312 is disposed on a lower surface of the adjusting slide plate 33 and used for reducing friction between the adjusting slide plate 33 and the base sliding plate 312, and the protruding point 331 is slidable relative to a top surface of the base sliding plate 312.

The roller assembly 32 includes a fixed plate 321, a rolling shaft 322 disposed vertical to the fixed plate 321, and a roller 323 disposed on the top of the rolling shaft 322. The adjusting slide plate is provided with a first waist-shaped groove 332, a second waist-shaped groove 333 and a third waist-shaped groove 334 sequentially disposed at intervals along a lengthwise direction of the adjusting slide plate 33, and an angle between the second waist-shaped groove 333 and the lengthwise direction of the adjusting slide plate 33 is not 0.

The adjusting slide plate 33 is connected to the base sliding plate 312 by a first riveting shaft 34 running though the first waist-shaped groove 332. The fixed plate 321 is connected to the base sliding plate 312 by a second riveting shaft 35 running though the second waist-shaped groove 333. The fixed plate 321, the adjusting slide plate 33 and the base sliding plate 321 are connected by a third riveting shaft 36 running through the third waist-shaped groove 334.

In one embodiment, a first bending arm 3112 is disposed at an end of the base fixed plate 311, a second bending arm 3122 is disposed at an end of the base sliding plate 312, and a third bending arm 335 is disposed at an end of the adjusting slide plate 33. The first bending arm 3112 is connected to the second bending arm 3122 by a third adjusting screw 37, the second bending arm 3122 is connected to the third bending arm 335 by a fourth adjusting screw 38, and the third adjusting screw 37 and the forth adjusting screw 38 are provided with screw threads.

In the guide mechanism adopting the above-mentioned structure, the relative sliding between the roller assembly 32 and the adjusting slide plate 33 and the relative sliding between the base sliding plate 312 and the adjusting slide plate 33 are adjusted to prevent the frame body from being damaged when the guide mechanism is mounted, and the angle between the lengthwise direction of the roller assembly 32 and the lengthwise direction of the base sliding plate 312 is adjusted to prevent the decentration caused in the process of mounting the door leaf and the doorframe, so that the door leaf can slide relative to the outer frame smoothly.

Figure 10:
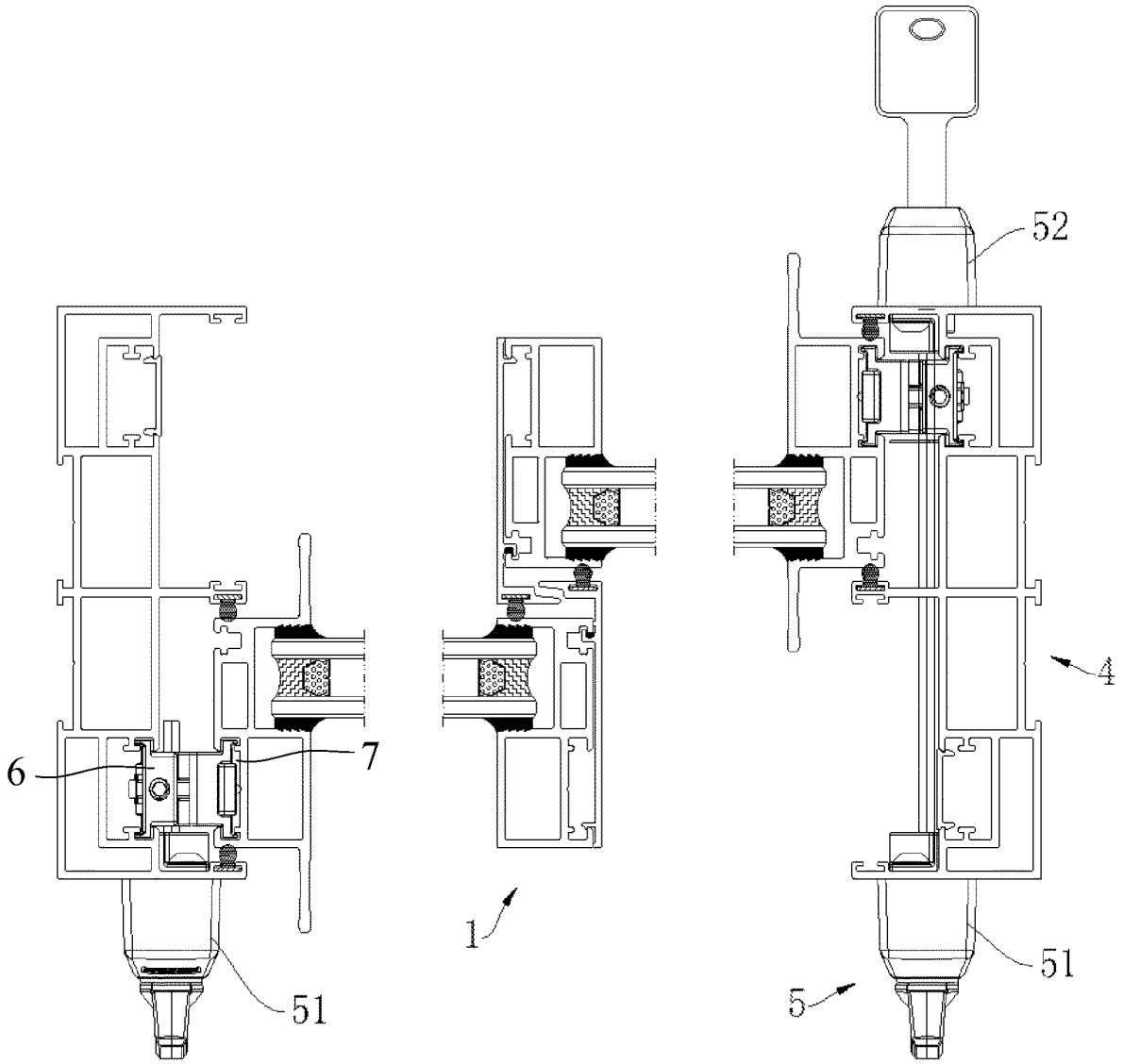
FIG. 10 is a sectional view of FIG. 1 taken along B-B.
Figure 11:
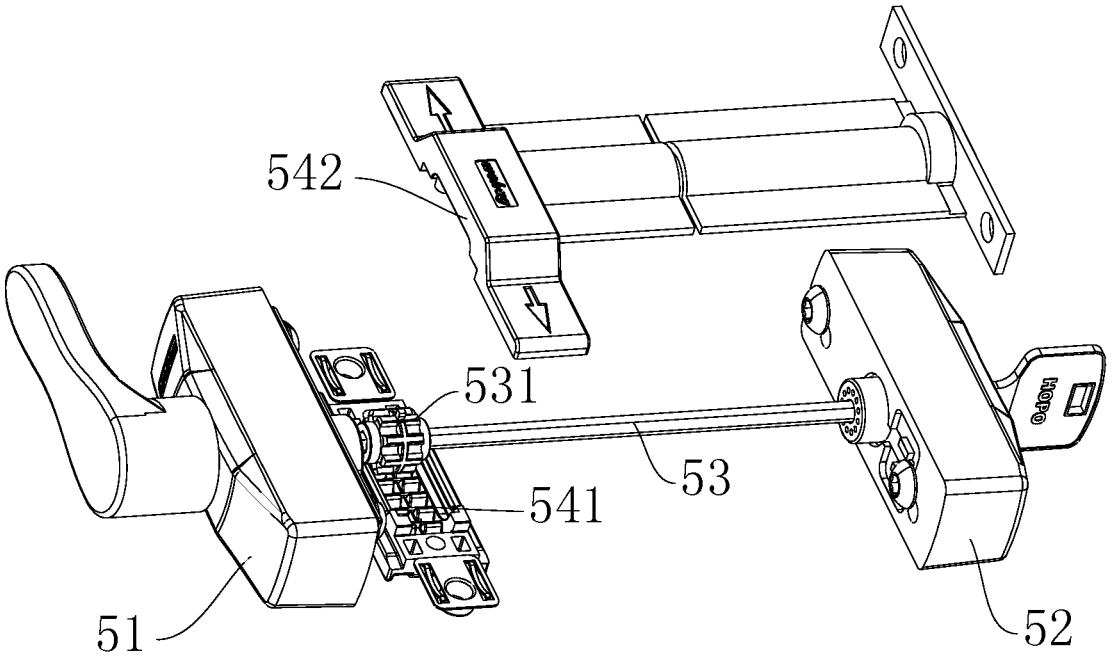
FIG. 11 is an exploded view of a door locking device in FIG. 10.

On the basis of the above-mentioned embodiment of the present disclosure, in combination with FIGS. 10 and 11, this embodiment of the present disclosure provides a sliding door. The sliding door includes the above-mentioned narrow frame structure, an outer frame body 4 and a door lock 5 disposed on the outer frame body 4 and used for opening and closing the narrow frame structure.

The door lock 5 includes an internal handle 51 disposed on the inner side frame of the outer frame body, a lock body 52 disposed on the outer side frame of the outer frame body 4, a transmission shaft 53 disposed between the internal handle 51 and the lock body 52, an actuator meshed with the transmission shaft 53 and slidable along a radial direction of the transmission shaft 53, the actuator is used for driving a spring bolt which is used for opening and closing the frame body, the spring bolt is clamped to a lock-slot disposed on a side wall of the frame body 1. The actuator includes a rack 541 disposed on a first side of the transmission shaft 53 and a rack cover 542 disposed on a second side of the transmission shaft 53 and snap-fitted with the rack 541, and the rack 541 is meshed with a gear 531 fixed to the transmission shaft 53.

In an embodiment of the present disclosure, the outer frame body 4 is a door frame, the internal handle and lock body are disposed on the inner side of the door frame and the outer side of the door frame respectively. The two ends of the transmission shaft are connected to the internal handle and lock body. During the unlocking, the internal handle or a key on the lock body can be rotated to drive the transmission shaft to rotate and drive the actuator to move back and forth along a height direction of the door frame. A spring bolt connected to the actuator is disposed in a side frame of the door frame, and a lock-slot capable of holding the spring bolt is disposed on a side of the door frame which is opposite to the side wall of the door leaf. This structure enables opening and closing of the two door leaves and the door frame and avoids the problem in which the frame of the door leaf is widened and the area of the glass not embedded in the frame is reduced when the door lock 5 is disposed on the door leaf in the related art.

On the basis of the above-mentioned embodiment of the present disclosure, in an embodiment of the present disclosure, referring to FIGS. 10 and 11, the actuator is used for driving a locking lever 6 of the frame body, and the locking lever 6 is clamped to a lock seat 7 disposed on the side wall of the frame structure 1.

In an embodiment of the present disclosure, the outer frame body 4 is a door frame, the internal handle 51 and lock body 52 are disposed on the inner side of the door frame and the outer side of the door frame respectively. The two ends of the transmission shaft 53 are connected to the internal handle 51 and lock body 52. During the unlocking, the internal handle 51 or a key on the lock body 52 can be rotated to drive the transmission shaft 53 to rotate and drive the actuator to move back and forth along a height direction of the door frame. The locking lever 6 connected to the actuator is disposed in a side frame of the door frame, and the lock seat 7 capable of holding the locking lever 6 is disposed on a side of the door frame which is opposite to the side wall of the door leaf. This structure enables opening and closing of the two door leaves and door frame avoids the problem in which the frame of the door leaf is widened and the area of the glass not embedded in the frame is reduced when the door lock 5 is disposed on the door leaf in the related art.

What is claimed is:

1. A frame structure, comprising:

a frame body;

a corner connector and roller mechanism arranged at a splice of adjacent side frames at a bottom of the frame body; and a guide mechanism engaged with a top of the frame body;

wherein a glass positioning slot is disposed on a first side of an inner side wall of a side frame of the frame body, a mounting slot for fixing the guide mechanism or the corner connector and roller mechanism is disposed on a first side of an outer side wall of the side frame of the frame body, and the glass positioning slot is adjacent to the mounting slot along a lengthwise direction of the first side of the inner side wall, wherein the guide mechanism comprises a base assembly inserted into the mounting slot, and a roller assembly disposed on the base assembly, wherein the base assembly comprises a base fixed plate and a base sliding plate disposed on the base fixed plate and slidable relative to the base fixed plate, a first groove is disposed on an upper surface of the base fixed plate, a first protrusion is disposed on a lower surface of the base sliding plate, and the first protrusion is fitted with the first groove;

when the base sliding plate slides along a lengthwise direction of the base fixed plate and the first protrusion is embedded in the first groove, the base assembly is loosely fitted with the mounting slot; and when the base sliding plate slides along the lengthwise direction of the base fixed plate and the first protrusion is not embedded in the first groove, the base assembly is tightly fitted with the mounting slot.

2. The frame structure according to claim 1, wherein the corner connector and roller mechanism comprises a corner connector for splicing and mounting the adjacent side frames, and a roller adjustment assembly for adjusting a gap between the frame body and an external frame part, which is integrally arranged in a cavity of the corner connector.

3. The frame structure according to claim 2, wherein the corner connector comprises a first corner connector unit, a second corner connector unit and a locking mechanism disposed between the first corner connector unit and the second corner connector unit, wherein the locking mechanism comprises an adjusting screw and an adjusting block installed with the adjusting screw, two positioning sliding slots are respectively disposed on the first corner connector unit and the second corner connector unit, one of the two positioning sliding slots disposed on the first corner connector unit is opposite to another of the two positioning sliding slots disposed on the second corner connector unit, and the locking mechanism is disposed in the two positioning sliding slots.

4. The frame structure according to claim 2, wherein the roller adjustment assembly comprises an outer support, an inner support arranged on an inner side of the outer support, and an adjusting screw disposed at an end of the outer support and installed in the corner connector.

5. The frame structure according to claim 4, wherein a first side wall of the inner support is a side of the inner support facing away from the outer support, a roller adjusting shaft is disposed between first side walls of two inner supports, two ends of the roller adjusting shaft penetrate through the inner support, the roller adjusting shaft is slidable in a sliding slot disposed through a side wall of the outer support, an angle between an extension direction of the sliding slot and a lengthwise direction of the side wall of the outer support is not 0, and each of the two ends of the roller adjusting shaft is disposed in a respective one of positioning slots on two opposite side walls of the cavity of the corner connector.

6. The frame structure according to claim 1, wherein the guide mechanism further comprises an adjusting slide plate for adjusting a deflection of the roller assembly along a width direction of the base assembly, which is disposed between the roller assembly and the base sliding plate, wherein a protruding point protruding towards the base sliding plate is disposed on a lower surface of the adjusting slide plate and used for reducing friction between the adjusting slide plate and the base sliding plate, and the protruding point is slidable relative to a top surface of the base sliding plate.

7. The frame structure according to claim 6, wherein the roller assembly comprises a fixed plate, a rolling shaft disposed vertical to the fixed plate, and a roller disposed on a top of the rolling shaft; wherein the adjusting slide plate is provided with a first waist-shaped groove, a second waist-shaped groove and a third waist-shaped groove sequentially disposed at intervals along a lengthwise direction of the adjusting slide plate, and an angle between the second waist-shaped groove and the lengthwise direction of the adjusting slide plate is not 0; wherein the adjusting slide plate is connected to the base sliding plate by a first riveting shaft running though the first waist-shaped groove; wherein the fixed plate is connected to the base sliding plate by a second riveting shaft running though the second waist-shaped groove; wherein the fixed plate, the adjusting slide plate and the base sliding plate are connected by a third riveting shaft running through the third waist-shaped groove; wherein a first bending arm is disposed at an end of the base fixed plate, a second bending arm is disposed at an end of the base sliding plate, and a third bending arm is disposed at an end of the adjusting slide plate; and wherein the first bending arm is connected to the second bending arm by a first adjusting screw provided with screw threads, and the second bending arm is connected to the third bending arm by a second adjusting screw provided with screw threads.

8. A sliding door, comprising a frame structure, wherein the frame structure comprises:

a frame body;

a corner connector and roller mechanism arranged at a splice of adjacent side frames at a bottom of the frame body; and a guide mechanism engaged with a top of the frame body;

wherein a glass positioning slot is disposed on a first side of an inner side wall of a side frame of the frame body, a mounting slot for fixing the guide mechanism or the corner connector and roller mechanism is disposed on a first side of an outer side wall of the side frame of the frame body, and the glass positioning slot is adjacent to the mounting slot along a lengthwise direction of the first side of the inner side wall, wherein the guide mechanism comprises a base assembly inserted into the mounting slot, and a roller assembly disposed on the base assembly, wherein the base assembly comprises a base fixed plate and a base sliding plate disposed on the base fixed plate and slidable relative to the base fixed plate, a first groove is disposed on an upper surface of the base fixed plate, a first protrusion is disposed on a lower surface of the base sliding plate, and the first protrusion is fitted with the first groove;

when the base sliding plate slides along a lengthwise direction of the base fixed plate and the first protrusion is embedded in the first groove, the base assembly is loosely fitted with the mounting slot; and when the base sliding plate slides along the lengthwise direction of the base fixed plate and the first protrusion is not embedded in the first groove, the base assembly is tightly fitted with the mounting slot; and wherein the sliding door further comprises:

an outer frame body; and a door lock disposed on the outer frame body and used for opening and closing a frame body of the frame structure.

9. The sliding door according to claim 8, wherein the door lock comprises:

a first handle disposed on a first side of the side frame of the outer frame body;

a lock body disposed on a second side of the side frame of the outer frame body;

a transmission shaft disposed between the first handle and the lock body;

and an actuator meshing with the transmission shaft and sliding along the transmission shaft in a radial direction, the actuator is configured to drive a spring bolt for opening and closing the frame body, wherein the spring bolt is clamped to a lock-slot disposed on a side wall of the frame body, wherein the actuator comprises a rack disposed on a first side of the transmission shaft and a rack cover disposed on a second side of the transmission shaft and snap-fitted to the rack, and the rack meshes with a gear fixed to the transmission shaft.

10. The sliding door according to claim 8, wherein the door lock comprises:

a first handle disposed on a first side of a side frame of the outer frame body;

a lock body disposed on a second side of the side frame of the outer frame body;

a transmission shaft disposed between the first handle and the lock body;

and an actuator meshing with the transmission shaft and sliding along the transmission shaft in a radial direction, the actuator is configured to drive a locking lever for opening and closing the frame body, wherein the locking lever is clamped to a lock seat disposed on a side wall of the frame body, wherein the actuator comprises a rack disposed on a first side of the transmission shaft and a rack cover disposed on a second side of the transmission shaft and snap-fitted to the rack, and the rack meshes with a gear secured to the transmission shaft.

11. The sliding door according to claim 8, wherein the corner connector and roller mechanism comprises a corner connector for splicing and mounting the adjacent side frames, and a roller adjustment assembly for adjusting a gap between the frame body and an external frame part, which is integrally arranged in a cavity of the corner connector.

12. The sliding door according to claim 11, wherein the corner connector comprises a first corner connector unit, a second corner connector unit and a locking mechanism disposed between the first corner connector unit and the second corner connector unit, wherein the locking mechanism comprises an adjusting screw and an adjusting block installed with the adjusting screw, two positioning sliding slots are respectively disposed on the first corner connector unit and the second corner connector unit, one of the two positioning sliding slots disposed on the first corner connector unit is opposite to another of the two positioning sliding slots disposed on the second corner connector unit, and the locking mechanism is disposed in the two positioning sliding slots.

13. The sliding door according to claim 11, wherein the roller adjustment assembly comprises an outer support, an inner support arranged on an inner side of the outer support, and an adjusting screw disposed at an end of the outer support and installed in the corner connector.

14. The sliding door according to claim 13, wherein a first side wall of the inner support is a side of the inner support facing away from the outer support, a roller adjusting shaft is disposed between first side walls of two inner supports, two ends of the roller adjusting shaft penetrate through the inner support, the roller adjusting shaft is slidable in a sliding slot disposed through a side wall of the outer support, an angle between an extension direction of the sliding slot and a lengthwise direction of the side wall of the outer support is not 0, and each of the two ends of the roller adjusting shaft is disposed in a respective one of positioning slots on two opposite side walls of the cavity of the corner connector.

15. The sliding door according to claim 8, wherein the guide mechanism further comprises an adjusting slide plate for adjusting a deflection of the roller assembly along a width direction of the base assembly, which is disposed between the roller assembly and the base sliding plate, wherein a protruding point protruding towards the base sliding plate is disposed on a lower surface of the adjusting slide plate and used for reducing friction between the adjusting slide plate and the base sliding plate, and the protruding point is slidable relative to a top surface of the base sliding plate.

16. The sliding door according to claim 15, wherein the roller assembly comprises a fixed plate, a rolling shaft disposed vertical to the fixed plate, and a roller disposed on a top of the rolling shaft; wherein the adjusting slide plate is provided with a first waist-shaped groove, a second waist-shaped groove and a third waist-shaped groove sequentially disposed at intervals along a lengthwise direction of the adjusting slide plate, and an angle between the second waist-shaped groove and the lengthwise direction of the adjusting slide plate is not 0; wherein the adjusting slide plate is connected to the base sliding plate by a first riveting shaft running though the first waist-shaped groove; wherein the fixed plate is connected to the base sliding plate by a second riveting shaft running though the second waist-shaped groove; wherein the fixed plate, the adjusting slide plate and the base sliding plate are connected by a third riveting shaft running through the third waist-shaped groove; wherein a first bending arm is disposed at an end of the base fixed plate, a second bending arm is disposed at an end of the base sliding plate, and a third bending arm is disposed at an end of the adjusting slide plate; and wherein the first bending arm is connected to the second bending arm by a first adjusting screw provided with screw threads, and the second bending arm is connected to the third bending arm by a second adjusting screw provided with screw threads.

* * * * *